United States Patent [19]

Deprettere et al.

[11] Patent Number: 4,736,428

[45] Date of Patent: Apr. 5, 1988

[54] MULTI-PULSE EXCITED LINEAR PREDICTIVE SPEECH CODER

[75] Inventors: Edmond F. A. Deprettere, The Hague; Peter Kroon, Vlaardingen, both of Netherlands

[73] Assignee: U.S. Philips Corporation, New York, N.Y.

[21] Appl. No.: 639,176

[22] Filed: Aug. 9, 1984

[30] Foreign Application Priority Data

Aug. 26, 1983 [NL] Netherlands ..... 8302985

[51] Int. Cl.[4] ..... G10L 5/00

[52] U.S. Cl. ..... 381/38

[58] Field of Search ..... 381/36–39, 381/47

[56] References Cited

U.S. PATENT DOCUMENTS

| | | | |
|---|---|---|---|
| 3,750,024 | 7/1973 | Dunn | 381/36 |
| 4,133,976 | 1/1979 | Atal et al. | 381/47 |
| 4,516,259 | 5/1985 | Yato et al. | 381/36 |

OTHER PUBLICATIONS

Atal et al., "A New Model of LPC Excitation etc.", ICASS P-82 Proceedings, IEEE 1982, pp. 614–617.

*Primary Examiner*—Emanuel S. Kemeny

*Attorney, Agent, or Firm*—Thomas A. Briody; Jack E. Haken; Anne E. Barschall

[57] ABSTRACT

A multipulse excitation signal, as a better approximation than a single-pulse excitation signal, searches for a kth pulse which minimizes either a difference between a synthesized and a reference signal, or a distance between a multipulse excitation signal and a residual signal. The search uses an averaging function $M_k$ (n) of a weighted error signal.

8 Claims, 2 Drawing Sheets

$L_1^e < L1 \leqslant L$

MULTI-PULSE EXCITED LINEAR PREDICTIVE SPEECH CODER

The invention relates to a multi-pulse excited linear predictive speech coder, comprising a multi-pulse excitation signal generator, means for perceptually weighting the difference between a signal synthesized by means of a synthesizing operation from the multi-pulse excitation signal and the multi-pulse excitation signal itself, respectively, and the reference speech signal and a residual signal derived from the reference speech signal by means of an analysing operation which is the inverse of the said synthesizing operation, respectively, for generating a weighted error signal and means for controlling the multi-pulse excitation generator in response to the weighted error signal, in order to reduce the error signal.

Such a speech coder is disclosed in the Proceedings of the ICASSP—82, Paris, April 1982, pages 614–617.

Figure 1:
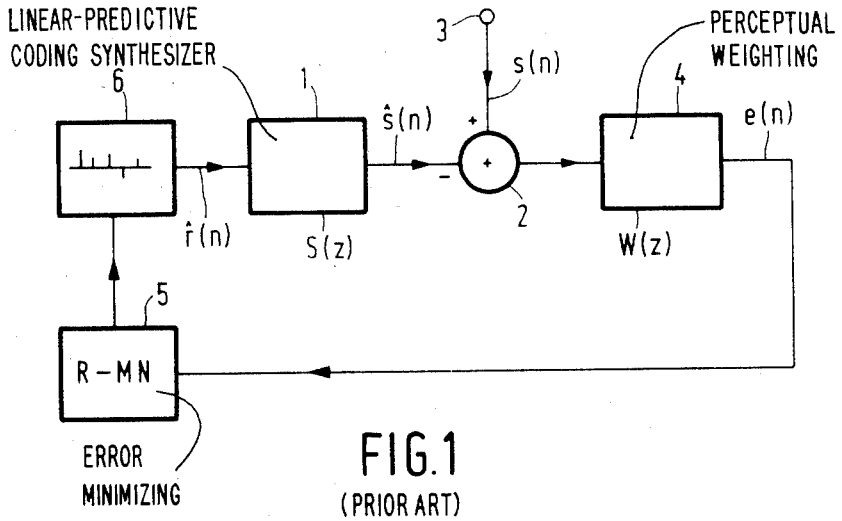
FIG.1 (PRIOR ART)

FIG. 1 shows the block diagram of such a multi-pulse excited speech coder (vocoder), which functions in accordance with the analysis-by-synthesis principle. In response to a multi-pulse signal $\hat{r}(n)$ a linear-predictive speech synthesizer 1 (LPC-SNT) produces synthetic speech samples $\hat{s}(n)$ which, in a difference producer 2, are compared with the reference speech samples $\hat{s}(n)$ which are applied to an input terminal 3. The difference $s(n)-\hat{s}(n)$ is perceptually weighted in block 4 (PRC-WGH) and the result is a weighted error signal e(n).

In response to the error signal e(n), block 5 (R-MN) effects a control of the multi-pulse excitation signal generator 6, which produces the multi-pulse signal $\hat{r}(n)$, such that the synthetic speech signal $\hat{s}(n)$ reproduces the reference speech signal s(n) to the best possible extent. The procedure followed in block 5 is called the error-minimizing procedure.

Perceptually weighting the difference signal $s(n)-\hat{s}(n)$ in block 4 is effected by means of a transfer function denoted by W(z) in the Z-transform notation. This transfer function can be formed in such manner, that comparatively large errors are allowed in the formant areas as compared to the intermediate areas.

Let $A_p(z)$ in the Z-transform notation represent the transfer function of the inverse LPC-filter. In terms of the inverse filter coefficients $a_{p\,k}$ the inverse filter transfer function is given by:

$$A_p(z) = 1 - \sum_{k=1}^{p} a_{p,k} z^{-k} \tag{1}$$

A suitable choice for W(z) is given by:

$$W(z) = \frac{A_p(z)}{A_{q,\gamma}(z)} = \left[1 - \sum_{k=1}^{p} a_{p,k} z^{-k}\right] \Big/ \left[1 - \sum_{k=1}^{q} a_{q,k}\, \gamma^k z^{-k}\right] \tag{2}$$

where $0 \leqq \gamma \leqq 1$ and $q \leqq p$.

The synthesizer 1 may be considered to be a filter having a transfer function S(z) which is given by $S(z)=1/A_p(z)$. The expression shown in FIG. 2*a* then hold for the combination of synthesizer 1 and the perceptual error weighting arrangement 4. They change into those of FIG. 2*b* for the case in which the numerator function $A_p(z)$ is split-off from transfer function W(z) of block 4 and is shifted to the input side of difference producer 2 emerging as block 8 on the one hand and disappearing in the combination with the synthesizer function $S(z)=1/A_p(z)$ of block 1 on the other hand. In block 7 is left the transfer function $G(z)=1/A_{q,\gamma}(z)$.

Figure 2A:
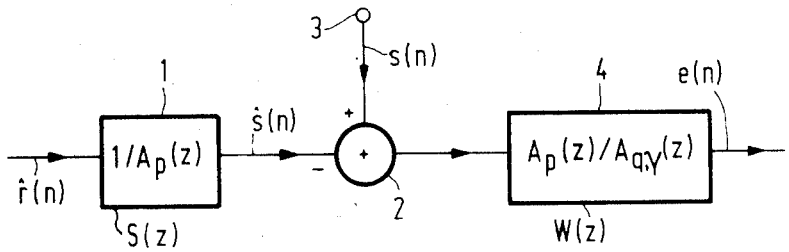
FIG.2a (PRIOR ART)
Figure 2B:
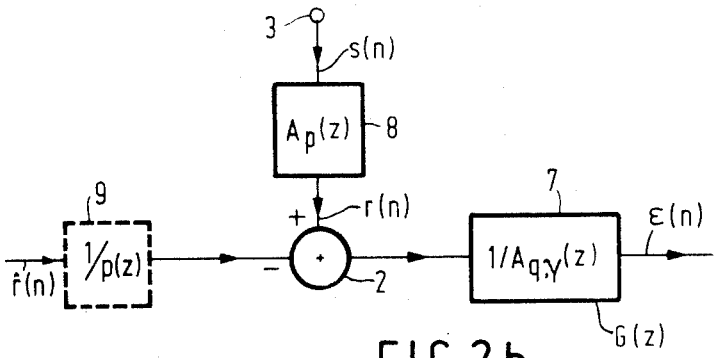

In FIG. 2*b* the filtering operation on the reference speech signal s(n) by the inverse LPC-filter $A_p(z)$ produces the residual signal r(n). This signal is compared with the multi-phase model $\hat{r}(n)$ thereof in the difference producer 2 and the difference is weighted in block 7 in accordance with the filter function $1/A_{q,\gamma}(z)$. The result is the error signal $\epsilon(n)$ which has a strong correlation with the error signal e(n).

The reproduced speech will increase in quality by the insertion of a pitch predictor filter 9 into the lead to difference producer 2 carrying the signal $\hat{r}(n)$ and having the transfer function 1/P(z) wherein $P(z)=1-\beta z^{-M}$.

In the above transfer function 1/P(z) the factor $\beta$ has an absolute value smaller than 1 and M represents the distance between the pitch pulses in number of samples. These values may be calculated for segments of suitable length, say N from the speech correlation function:

$$r(k) = \sum_{n=1}^{N} s(n)s(n+k), \tag{9}$$

M is the value of $k \neq 0$ for which r(k) reaches a maximum value and $\beta$ is proportional to r(M). The range of values of M at a sample frequency of 8 KHz is typically from 16 to 160.

Figure 6:
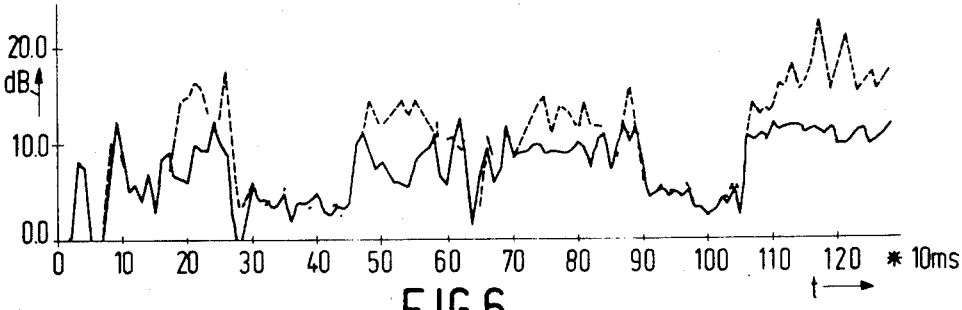

The effect of the inclusion of the inverse pitch predictor as represented by block 9 in FIG. 2*b* is shown in FIG. 6 wherein the signal-to-noise ratio of the reproduced speech is represented in dB versus time per segment of 10 msec. for a sequence of such segments. The drawn line is without the pitch predictor and the dashed line with the pitch predictor.

The FIGS. 1 and 2*a* represent the prior art as shown in the above-mentioned article or, as for the case represented in FIG. 2*b*, extensions thereof.

In addition, the FIGS. 2*a* and 2*b* represent alternative methods of calculating a significant error signal e(n) or $\beta(n)$, the latter having the advantage if a simple structure.

The complexity of the speech coder shown in FIG. 1 is determined to an important extent by the procedure represented by block 5, i.e. the error minimizing procedure, in accordance with which the position and the amplitude of the pulses in the multi-pulse excitation signal $\hat{r}(n)$ are determined.

According to the prior art, in a given interval having a given number of possible pulse positions that position is determined, pulse for pulse, which minimizes a mean square error (m.s.e.) function or square distance function $E_k(b,l)$, where k is the number, b the amplitude and l the position of the pulse under consideration. The number of function calculations will then be approximately equal to the product of the number of pulses to be determined and the number of pulse positions possible in the given interval.

The invention has for its object to provide a speech coder of the type specified in the preamble with a reduced complexity.

According to the invention, the speech coder is characterized in that in order to determine the position of the $k^{th}$ pulse in a givn interval in the multi-pulse excitation signal an auxiliary function ($M_k(n)$) is determined, which is a measure of the energy of the weighted error signal on the basis of a multi-pulse excitation signal of which (k−1) pulses have been determined, that means are present for determining the value $n'_k$ of n for which the auxiliary function ($M_k(n)$) is the maximum, that means are present for determining a reduced interval shorter than the predetermined given interval, in the region of $n'_k$, and means for determining the position of the $k^{th}$ pulse of the multi-pulse excitation signal in the reduced interval.

The auxiliary function $M_k(n)$ can be chosen such that it can be calculated in a simple way. The number of distance functions to be calculated by means of the method according to the invention is equal to the product of the number of pulses of the excitation signal to be determined in the given interval and the number of possible pulse positions in the reduced interval. As the reduced interval can be of a much shorter length than the predetermined given interval, the number of necessary calculations is significantly reduced and thus the complexity of the speech coder is reduced.

The invention will now be described in greater detail by way of example with reference to the accompanying Figures and an embodiment.

FIG. 1 shows a block diagram of a prior art speech coder (vocoder).

Figure 3:
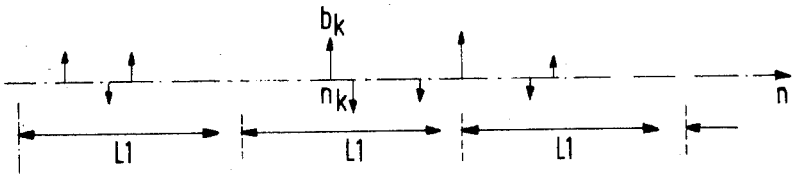

FIG. 2*a* and 2*b* show alternative methods for the determination of a weighted error signal:

FIG. 3 shows a time scale (n) along which a multi-pulse excitation signal $$\bar{r}(n)=\Sigma bk\delta(n-n_k);\ k=1,2,3, \tag{3}$$

is plotted.

Figure 4A:
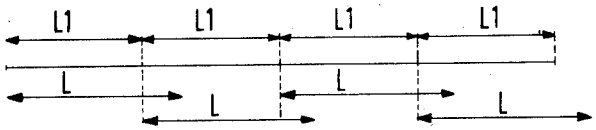
Figure 4B:
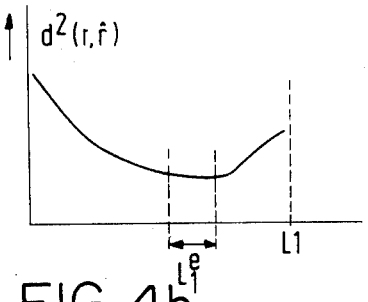

FIGS. 4*a* and 4*b* illustrate the relations between the different intervals.

Figure 5A:
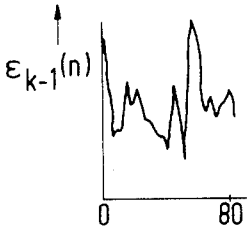
Figure 5B:
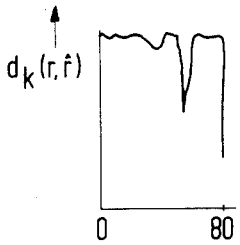

FIGS. 5*a* and 5*b* illustrate a typical error signal and a typical distance function, respectively.

FIG. 6 illustrates the signal-to-noise ratio of the reproduced speech with and without the use of a pitch predictor.

In the speech coder according to the invention which will be described hereafter the weighted error signal ($\epsilon(n)$) will be calculated in accordance with the method as shown in FIG. 2*b* at first without block 9. Herein:

$$G(z)=1/A_{q,\gamma}(z) \tag{4}$$

and $$W(z)=A_p(z)\cdot G(z) \tag{5}$$

In block 5 (FIG. 1) a distance function $d(r,\hat{r})$:

$$d(r,r)=\left\{\frac{1}{2\pi}\int_{-\pi}^{+\pi}[R(e^{j\theta})-R(e^{j\theta})]\cdot |G(e^{j\theta})|^2\cdot[R(e^{-j\theta})-R(e^{-j\theta})]d\theta\right\}^{\frac{1}{2}} \tag{6}$$

is calculated between the residual signal $\hat{r}(n)$—Fourier transform $R(e^{j\theta})$—and the multi-pulse excitation signal $\hat{r}(n)$—Fourier transform $R(re^{j\theta})$.

The error minimizing procedure of block 5 controls excitation signal generator 6 in such manner, that the synthetic speech signal $\hat{s}(n)$ (FIG. 1) is obtained from a multi-pulse excitation signal $\hat{m}(n)$ for which the distance function $d(r,\hat{r})$ is at a minimum.

The error signal $\epsilon(n)$ (FIG. 2*b*) is given by:

$$\epsilon(n)=(r(n)-\hat{r}(n))*(g(n) \tag{7}$$

where g(n) is the impulse response of the filter 7 with the transfer function G(z) and * respresents the convolution operation.

As is illustrated in FIG. 3, the multi-pulse excitation signal is divided into segments of the length L1. This length is less than or equal to the length L of the interval over which the distance function $d(r,\hat{r})$ (6) is calculated ($L1 \leqq L$). The number of possible pulse positions within a segment of the length L1 is, for example, 80, whereas within each segment the positions and amplitudes of, for example, 8 pulses must be determined which minimize the distance function.

According to the invention, the search for a suitable pulse position is always limited to a reduced interval or search interval of the length $L_l^e$ which is less than the length L1($L_l^e \leqq L1$), preferably much less, comprising, for example, 5 to 10 possible pulse positions. The positons of the search intervals of the length $L_l^e$ within an interval of the length L1 are generally different for different pulses of the multi-pulse excitation signal. The above-mentioned ratios are illustrated in FIGS. 4*a* and 4*b*. As is illustrated in FIG. 4*b* the positions of the search interval of the length $L_l^e$ will be in the region of the minimum of the square of the distance function $d(r,\hat{r})$.

The invention is based on the recognition that there is a high degree of correlation between the local minimum of the distance function $d(r,\hat{r})$ and the local concentration of energy in the error signal which is optimized by the preceding pulse determinations. The distance function of the $k^{th}$ pulse determination is indicated by $d_k(r,\hat{r})$. Instead of an energy calculation, use is made of an average magnitude auxiliary function $M_k(n)$ which is given by:

$$M_k(n)=\sum_{i=0}^{m}|\epsilon_k(n-i)|,\ n=1,\ldots,L_1 \tag{8}$$

where m is the length of the integration interval, k is the number of the pulse of the muli-pulse excitation signal $\hat{r}(n)$ and $\epsilon_k(n)$ is the weighted error signal in accordance with the method shown in FIG. 2*b* when k pulses of the multi-pulse excitation have been determined.

FIGS. 5*a* and 5*b*, respectively show by way of illustration a typical error signal $\epsilon_{k-1}(n)$ and a typical distance function $d_k(r,\hat{r})$ in a mutual relationship.

The procedure for the determination of a pulse in the multi-pulse exitation signal is as follows. When $M_{k-1}(n)$ reaches its maximum at $n=n'_k$, then the distance function $d_k(r,\hat{r})$ is calculated for each available pulse position in the search interval, of the length $L_l^e$, which is situated in the region of $n'_k$. The suitable value for $L_l^e$ will depend on the length of m the integration interval and on the specific nature of the impulse response of the synthesis filter. In this example fixed-length search intervals are used. In the search interval the pulse position is then determined corresponding to the minimum of the distance function (FIG. 4*b*).

This procedure is repeated until the desired number of pulse positions in the given interval of length L1 has been determined, whereafter a sub-sequent interval is proceeded to.

The following details can be given by way of illustration:

sample frequency: 8 KHz;

$L_f^e$: 5 to 10 possible pulse positions;

L1: 80 possible pulse positions;

number of pulse positions to be determined within interval L1: 8 to 10;

integration invertal, m=4.

The position of the search interval of length $L_f^e$ relative to the maximum of the auxiliary function $M_k(n)$ will adequately be such that it precedes this maximum with, optionally, a suitable shift (offset) relative to this maximum.

The auxiliary function $M_k(n)$ can be released by an integrator to which the magnitude of the error signal $\epsilon_k(n)$ is applied and which integrates it over m pulse positions.

As has been indicated with respect to FIG. 2*b*, the quality of the synthesized speech will considerably improve when a pitch predictor 9 is inserted in the lead for the multi-pulse excitation signal $\hat{r}(n)$.

For the purpose of this specification the term multi-pulse excitation signal is considered generic for the multi-pulse excitation signal $\hat{r}(n)$ as indicated in the figures and the signal appearing at the output of the pitch predictor 9 in FIG. 2*b* when such predictor is in fact included and the multi-pulse excitation signal $\hat{r}(n)$ is applied thereto.

What is claimed is:

1. A multi-pulse excited linear predictive speech coder comprising:

a. a multi-pulse excitation signal generator for generating a multi-pulse excitation signal and having a control input;

b. a linear-predictive speech synthesizer, for synthesizing a signal from the multi-pulse excitation signal to produce synthetic speech samples;

c. means for receiving a reference speech signal;

d. a difference generator for comparing the reference speech samples with the synthetic speech samples and producing a difference signal;

e. means for perceptually weighting the difference signal to produce a weighted error signal; and f. means for controlling the multi-phase excitation signal generator in response to the weighted error signal to minimize the weighted error signal;

wherein the improvement comprises:

g. means for determining a position of a $k^{th}$ pulse in a given interval of the multi-pulse excitation signal, where k is an integer, the $k^{th}$ pulse being one for which the difference signal is minimized, including:

i. means for producing an average magnitude auxiliary function ($M_k(n)$), which is a measure of the energy of the weighted error signal determined from the multi-pulse excitation signal after (k−1) pulses;

ii. means for identifying a value $n'_k$ of n for which the auxiliary function ($M_k(n)$) is maximized;

iii. means for determining a reduced interval, shorter than the given interval, in a region surrounding $n'_k$; and iv. means for searching for the $k^{th}$ pulse weighting the reduced interval, whereby computational complexity is reduced.

2. A method of multi-pulse excited linear predictive speech coding comprising the steps of:

a. generating a multi-pulse excitation signal;

b. synthesizing synthetic speech samples from the multi-pulse excitation signal to produce synthetic speech samples in a linear-predictive manner;

c. receiving a reference speech signal;

d. generating a difference signal representing a difference between the reference speech samples and the synthetic speech samples;

e. perceptually weighting the difference signal to produce a weighted error signal; and f. controlling the multi-pulse excitation signal generator in response to the weighted error signal to minimize the weighted error signal;

wherein the improvement comprises:

g. determining a position of a $k^{th}$ pulse in a given interval of the multi-pulse excitation signal, where k is an integer, the $k^{th}$ pulse being one for which the difference signal is minimized, including:

i. producing an average magnitude auxiliary function ($M_k(n)$), which is a measure of the energy of the weighted error signal determined from the multi-pulse excitation signal after (k−1) pulses;

ii. identifying a value $n'_k$ of n for which the auxiliary function ($M_k(n)$) is maximized;

iii. determining a reduced interval, shorter than the given interval, in a region surrounding $n'_k$; and iv. seraching for the $k^{th}$ pulse weighting the reduced interval, whereby computational complexity is reduced.

3. A multi-pulse excited linear predictive speech coder comprising:

a. a multi-pulse excitation signal generator producing a multi-pulse excitation signal and having a control input;

b. means for receiving a reference speech signal;

c. means for analyzing the reference speech signal to produce a residual signal, said analyzing means performing an analyzing operation which is the inverse of a linear-predictive synthesizing operation which produces synthetic speech samples from the multi-pulse excitation signal, whereby a speech synthesizer performing the synthesizing operation may be omitted from the coder;

d. means for generating a distance function signal measuring a distance between the residual signal and the multi-pulse excitation signal;

e. means for perceptually weighting the distance function signal to create a weighted error signal;

f. means for controlling the multi-pulse excitation generator in response to the weighted error signal to reduce the weighted error signal; and g. means for determining a position of a $k^{th}$ pulse in a given interval of the multi-pulse excitation signal, where k is an integer, the $k^{th}$ pulse being one for which the distance function signal is minimized, including:

i. means for producing an average magnitude auxiliary function ($M_k(n)$), which is a measure of the energy of the weighted error signal determined from the multi-pulse excitation signal after (k−1) pulses;

ii. means for identifying a value $n'_k$ of n for which the auxiliary function ($M_k(n)$) is maximized;

iii. means for determining a reduced interval, shorter than the given interval, in a region surrounding $n'_k$; and iv. means for searching for the $k^{th}$ pulse weighting the reduced interval, whereby computational complexity is reduced.

4. The coder of claim 3 wherein:

the distance function is:

$$d(r,r) = \left\{ \frac{1}{2\pi} \int_{-\pi}^{+\pi} [R(e^{j\theta}) - R(e^{j\theta}) \cdot |G(e^{j\theta})|^2 \cdot [R(e^{-j\theta}) - R(e^{-j\theta})]\, d\theta \right\}^{\frac{1}{2}}$$

the auxiliary function is:

$$M_K(n) = \sum_{i=0}^{m} |\epsilon_K(n-1)|,\ n = 1, \ldots L1$$

the given interval is less than an interval over which the distance function is calculated.

5. The method of claim 4 wherein:

(a) the distance function generating step comprises the step of calculating the distance function as:

$$d(r,r) = \left\{ \frac{1}{2\pi} \int_{-\pi}^{+\pi} [R(e^{j\theta}) - R(e^{j\theta})] \cdot |G(e^{j\theta})|^2 \cdot [R(e^{-j\theta}) - R(e^{-j\theta})]\, d\theta \right\}^{\frac{1}{2}};$$

(b) the auxiliary function determining step comprises the step of calculating the auxiliary function as:

$$M_K(n) = \sum_{i=0}^{m} |\epsilon_K(n-i)|,\ n = 1, \ldots L1; \text{ and}$$

(c) the position determining step comprises determining within the given interval which is less than an interval over which the distance function is calculated.

6. The coder of claim 4 comprising the step of predicting a pitch after generating the multipulse excitation signals before the distance function generating means.

7. The coder of claim 3 comprising a pitch predictor coupled between the multi-pulse excitation generator and the distance function generating means.

8. The method of multi-pulse excited linear predictive speech coding comprising the steps of:

a. controllably generating a multi-pulse excitation signal a multi-pulse excitation signal;

b. receiving a reference speech signal;

c. analyzing the reference speech signal to produce a residual signal, said analyzing step including an analyzing operation which is the inverse of a linear-predictive synthesizing operation which produces synthetic speech samples from the multi-pulse excitation signal, whereby no speech synthesizing step is performed;

d. generating a distance function signal measuring a distance between the residual signal and the multi-pulse excitation signal;

e. perceptually weighting the distance function signal to create a weighted error signal;

f. controlling the multi-pulse excitation generating step in response to the weighted error signal to reduce the weighted error signal; and g. determining a position of the $k^{th}$ pulse in a given interval of the multi-pulse excitation signal, where k is an integer, the $k^{th}$ pulse being one for which the distance function signal is minimized, including the steps of:

i. producing an average magnitude auxiliary function ($M_k(n)$), which is a measure of the energy of the weighted error signal determined from the multi-pulse excitation signal after (k−1) pulses;

ii. identifying a value $n'_k$, of n for which the auxiliary function ($M_k(n)$) is maximized;

iii. determining a reduced interval, shorter than the given interval, in a region surrounding $n'_k$; and iv. searching for the $k^{th}$ pulse within the reduced interval, whereby computational complexity is reduced.

* * * * *